US005663753A

United States Patent [19]

Story et al.

[11] Patent Number: 5,663,753

[45] Date of Patent: Sep. 2, 1997

[54] RECORDING CARTRIDGE WITH REPLACEABLE LIQUID-CONTAINING RESERVOIR

[75] Inventors: James D. Story, Houston, Tex.; Bruno L. Richet, Redwood City; Christopher B. Fruhauf, Stanford, both of Calif.

[73] Assignee: JetFill, Inc., Houston, Tex.

[21] Appl. No.: 339,469

[22] Filed: Nov. 14, 1994

[51] Int. Cl.[6] ..... B41J 2/175

[52] U.S. Cl. ..... 347/86

[58] Field of Search ..... 347/85–87; 222/321, 222/DIG. 1; 141/370

[56] References Cited

U.S. PATENT DOCUMENTS

| | | | |
|---|---|---|---|
| 4,998,115 | 3/1991 | Nevarez et al. | 347/87 |
| 5,119,115 | 6/1992 | Buat et al. | 347/66 |
| 5,495,877 | 3/1996 | Schwenk et al. | 141/370 |
| 5,509,140 | 4/1996 | Koitabashi et al. | 347/87 |

FOREIGN PATENT DOCUMENTS

| | | | |
|---|---|---|---|
| 0 560 729 A2 | 3/1993 | European Pat. Off. | B41J 2/175 |
| 0 560 729 A3 | 3/1993 | European Pat. Off. | B41J 2/175 |

*Primary Examiner*—Benjamin R. Fuller

*Assistant Examiner*—Judy Nguyen

*Attorney, Agent, or Firm*—Hitt Chwang & Gaines, PC

[57] ABSTRACT

The present invention provides a refill insert that is couplable to an ink jet printhead. The refill insert comprises a housing that has an enclosed, defined volume therein for receiving a predetermined quantity of ink. Included substantially within the structure of the housing is a subhousing having an interior volume in fluid communication with the defined volume of the housing. The housing further includes an ink egress port and an air ingress port that is separated a distance from the ink egress port and are in fluid communication with the subhousing. The ink egress port, which is in fluid communication with the printhead, and the air ingress port may be located on a single wall of the subhousing or they may be located on separate walls of the subhousing. Additionally, the subhousing and the housing may share a common wall. The subhousing completely spans the distance separating the ink egress port and the air ingress port with the interior volume of the subhousing encompassing the ink egress port. An ink entraining material, which is preferably comprised of a sponge, is disposed in the subhousing and is adapted to allow the ink to flow from within the housing to the ink egress port. Air enters the subhousing via the air ingress port to equalize a pressure of the housing with an ambient atmospheric pressure external to the housing.

41 Claims, 4 Drawing Sheets

RECORDING CARTRIDGE WITH REPLACEABLE LIQUID-CONTAINING RESERVOIR

BACKGROUND OF THE INVENTION

1. Field of the Invention

The present invention relates to ink jet printheads for ink jet printers, more specifically, to ink jet refill cartridges that are insertable into ink jet printheads.

2. Description of Related Art

Ink jet cartridges such as those used in ink jet printers, facsimiles, postal meters and other recording devices are generally well known in the art. These ink jet cartridges are generally comprised of a printhead, print circuitry and an integral ink container containing liquid ink to be supplied to the printhead. During printing, ink is expelled from the printhead through various ejection methods. The ink reservoir is drained during this process and eventually emptied. The structural components of the ink cartridge are durable and will last for numerous charges of ink. A substantial cost involved in the use of ink jet printers is the replacement of cartridges; over the life of the printer this cost is often two or three times the cost of the printer itself. Discarding the entire cartridge after the reservoir is emptied once is an expensive and wasteful practice.

As a result of the high cost and waste involved in disposing a fully functional, empty cartridge, many users refill ink cartridge reservoirs. Techniques have been developed to replenish ink reservoirs several times, dramatically extending the life of the cartridge.

There are several known methods and apparati for refilling the reservoirs. These methods require four main steps to refill a cartridge: fill hole access, refilling, fill hole sealing, and priming. All of the steps of the refill process present the risk of an messy ink spill. Various apparati are employed to assist in performing the four main refilling steps.

Aside from requiring a four-step process, all current methods for refilling ink reservoirs require a certain level of skill to accomplish successfully. As a result, these methods are often messy and may not yield a properly functioning cartridge. Consequently, the widespread acceptance of refilling ink jet cartridges has been limited.

Rather than inconvenience consumers with the risk of a mess, a new generation of refillable cartridges has been developed. This new generation is based on the refill manufacturer purchasing an ink jet cartridge with an integrated ink reservoir, such as the Hewlett-Packard 51633A Ink Jet Cartridge, and hollowing out the ink reservoir. The shell of the cartridge, containing the printhead and print circuitry for receiving electrical signals from a printer, may than be used to receive an ink reservoir adapted to fit therein.

These known systems have limitations. In addition, a replaceable reservoir must fit into the amount of space occupied by the original integrated reservoir. The resulting decrease in volume translates to a decrease in reservoir ink capacity. This results in environmental cost savings not being realized until the reservoir has been replaced several times.

The ink containment system can also detract from the volume of the reservoir. At least two of the systems known in the art employ reservoirs which are completely filled with a sponge. The sponge limits ink from freely flowing out of the coupling hole in the bottom of the reservoir, however, it occupies space, representing a severe limitation on the amount of ink that may be contained.

One of the reservoirs known in the art uses a design which is part sponge and part cavity. This yields the advantages of a sponge near the ink egress aperture, yet allows more ink to be contained. However, the reservoir described uses a relatively costly reservoir design having internal parts. For example, the air vent used to equalize pressure within the housing is located in the top portion of the primer bulb. Since there is a large quantity of free ink in the reservoir, a sophisticated system must be employed to prevent ink from coming out of the housing when the bulb is depressed. To obviate this problem, the device incorporates a second sponge (in addition to the sponge located over the ink egress aperture) through which air must first pass before reaching the interior of the housing. This additional sponge is positioned on the opposite side of the housing from the sponge covering the ink egress aperture and is connected by a tube to the air vent in the primer bulb. When saturated with ink, the additional sponge prevents the ink from leaking out of the housing when the primer bulb is depressed.

At least one of the known systems employs an electrical sensor to detect when the reservoir is low on ink. This increases manufacturing costs, as electrical contacts must be placed inside the cartridge housing and also contained within the reservoir. Another known system uses a priming button instead of electrical sensors. The priming button allows the reservoir to be used until completely empty, however, the spring-activated button is an additional part which increases assembly time and cost. One system known in the art has a priming circle integrated onto the reservoir as a thin, circular indentation on the wall of the reservoir. This is an optimal design, however, the priming circle has a hole, requiring an air filter within the reservoir to prevent ink from being sucked out of the reservoir after priming. The use of the filter displaces volume, and, as a result, approximately one-quarter less ink is held in the reservoir than in the original cartridge.

The ink reservoir must also be coupled to the cartridge housing. All of the known ink reservoirs contain a aperture to allow a flange in the cartridge housing to forcibly extend into the aperture. This allows ink to flow between the reservoir and the printhead. While the reservoir sponge prevents most ink leakage, some ink can still leak from the reservoir into the housing when the reservoir is inserted or removed, or if air is forced into the reservoir via a priming process. The known systems also use various attachment means to hold the reservoir to the housing.

Yet another device known in the art is the Canon BJ Cartridge BC-02. This device is a single cartridge comprised of two chambers separated by a partition wall through which the ink may pass. The first chamber is an free-ink filled chamber that does not have a sponge member contained therein. The second chamber holds a sponge that occupies the entire volume of the chamber. The ink aperture that is connected to printhead and the air vent opening are positioned on a side wall of the cartridge when in the operating position. While this device does have a reasonable storage capacity for ink, maximization of the ink storage is limited because the sponge occupies the entire volume of the second chamber. Thus, there is a substantial amount of potential ink storage capacity that is wasted in this particular device.

In another version of Canon's cartridge, there is no first free-ink chamber but a single sponge filled chamber, which, of course, has the same problems related to the other above-discussed prior art devices.

Therefore, it can readily be seen that there is a need in the art for a refill insert that is simply designed and provides for a larger capacity of ink but is less costly to manufacture. Accordingly, the present invention provides a refill insert that addresses these deficiencies.

SUMMARY OF THE INVENTION

To address the above-discussed deficiencies of the prior art, a better ink reservoir and coupling system has been developed.

The present invention provides a refill insert that is couplable to an ink jet printhead. In a preferred embodiment, the refill insert comprises a housing that has an enclosed, defined volume therein for receiving a predetermined quantity of ink. Included substantially within the structure of the housing is a subhousing having an interior volume in fluid communication with the defined volume of the housing. The housing includes an ink egress port and an air ingress port that is separated a distance from the ink egress port and are in fluid communication with the interior of the subhousing. The ink egress port, which is in fluid communication with the printhead, and the air ingress port may be located on a single wall of the subhousing or they may be located on separate walls of the subhousing. Additionally, the subhousing and the housing may share a common wall. The subhousing completely spans the distance separating the ink egress port and the air ingress port, and the interior volume of the subhousing encompasses the ink egress port. An ink entraining material, which is preferably comprised of a sponge, is disposed in the subhousing and is adapted to allow the ink to flow from within the housing to the ink egress port. Preferably, the sponge occupies the entire interior volume of the subhousing. Air enters the subhousing via the air ingress port to equalize a pressure of the housing with an ambient atmospheric pressure external to the housing.

In another aspect of the embodiment just described, the refill insert further includes a conduit portion adapted to allow fluid communication between said subhousing and said air ingress port. Preferably, the conduit is integrally formed with the subhousing and extends from the subhousing to the air ingress port. Additionally, the subhousing may further comprises an air channel located along an inner surface of the subhousing. This air channel allows air to pass through the subhousing and between the ink entraining material and the subhousing to equalize the pressure of the housing with the ambient atmospheric pressure. An intermediate port proximate a floor of the housing allows for the air and ink to communicate between the housing and the interior volume of the subhousing.

In another aspect of this embodiment, the refill insert may further comprise a priming structure for selectively increasing the pressure of the housing. Preferably, the priming structure is located on the top of the refill insert, and the housing is configured to be received within a shell of an ink cartridge having an open end. This particular embodiment has preferable application in the Hewlett-Packard 51633A Inkjet Cartridge. In yet another aspect, the refill insert includes means for attaching the insert to the ink jet printhead.

In another aspect of the present invention, the refill insert is couplable to an ink jet printhead, and the means for attaching is comprised of a locking member formed on a wall of the insert that is interengagable with a corresponding locking member formed on a wall of the ink cartridge shell. This particular embodiment has preferable application in the Canon BJ Cartridge BC-02 or the Hewlett-Packard 51633A Inkjet Cartridge.

In yet another aspect of the present invention, there is provided a method of providing a supply of ink to an ink jet printhead via a refill insert. The method comprises the steps of coupling the refill insert to the ink jet printhead and causing the ink to flow from within the housing, preferably to entrain the ink in a sponge. The step of causing preferably includes the step of allowing fluid communication between the subhousing and the air ingress port subhousing via a conduit portion or between the ink egress port and the ink jet printhead. Preferably, the ink communicates within the housing to within the subhousing via an intermediate port proximate a floor of the housing. The method may further comprise the step of disposing the ink entraining material in an entirety of the subhousing.

The method may further comprise the step of allowing air to pass through an air channel located along an inner surface of the subhousing to thereby equalize the pressure of the housing with the ambient atmospheric pressure and may further comprise the step of locating the ink egress port and the air ingress port on a single wall of the subhousing or on separate walls of the subhousing.

In another aspect of the method invention, the method may further comprise the step of selectively increasing the pressure of the housing with a priming structure.

In yet another aspect of the method invention, the step of the step of coupling comprises the step of engaging a locking member positioned on an exterior wall of the insert with a corresponding locking member positioned on a wall of the ink jet printhead.

The foregoing has outlined rather broadly the features and technical advantages of the present invention so that the detailed description of the invention that follows may be better understood. Additional features and advantages of the invention will be described hereinafter which form the subject of the claims of the invention. Those skilled in the art should appreciate that they can readily use the disclosed conception and specific embodiment as a basis for designing or modifying other structures to achieve the same purposes of the present invention. Those skilled in the art should also realize that such equivalent constructions do not depart from the spirit and scope of the invention as detailed in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
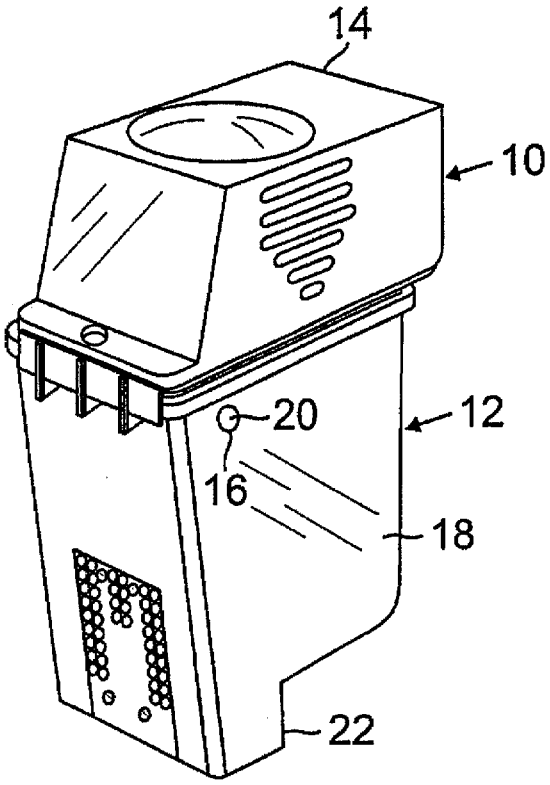
FIG. 1 illustrates a perspective view of the refill insert, displaying a replaceable reservoir received within an ink cartridge shell, preferably the Hewlett-Packard 51633A Inkjet Cartridge.

Referring initially to FIG. 1, in a preferred embodiment thereof, there is illustrated a refill insert 10 received within an ink jet printhead shell 12. The ink jet printhead shell 12 is represented by the housing of the conventional Hewlett-Packard 51633A Inkjet Cartridge, which is the preferable ink jet printhead shell 12 for the embodiment illustrated in FIG. 2. The refill insert 10 has a configuration that allows it to be substantially received in the ink jet printhead shell 12 with only a cap 14 residing outside the ink jet printhead shell 12. The ink jet printhead shell 12 has an aperture 16 formed in its wall 18 that is configured to receive a corresponding projection 20 formed on a wall of the refill insert 10. A conventional printhead 22 is located on the bottom of the ink jet printhead shell 12 for dispensing ink therefrom.

Figure 2:
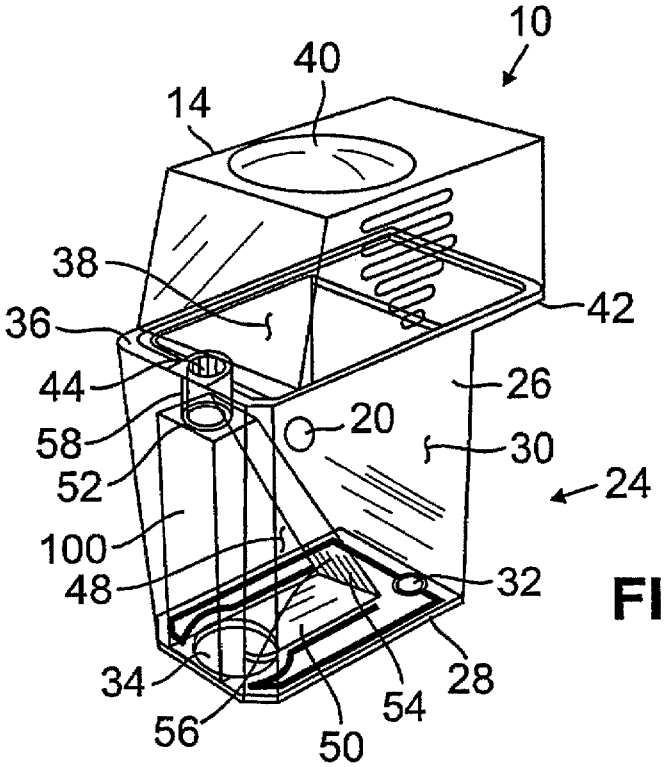
FIG. 2 illustrates the refill insert removed from the ink cartridge without the ink entraining material in the subhousing.

Turning now to FIG. 2, there is illustrated the refill insert 10 discussed in FIG. 1 that has been removed from the ink printhead shell 12. The refill insert 10 comprises a generally rectangular housing 24 having a side wall 26 secured to a floor wall 28 that form an interior portion 30 of the housing 24. Preferably, the floor wall 28 has an ink refill aperture 32 formed therein for allowing the housing 24 to be filled with ink and an ink egress port 34 for allowing a flow of ink from the housing 24 to the printhead of the ink jet printhead 12 (FIG. 1). The cap 14 is secured to the top portion 36 of the housing 24 and sealing covers an opening 38 of the housing 24 to prevent the leakage of ink therefrom. Preferably, the cap 14 further includes a priming structure 40 for selectively increasing the pressure within the interior 30 of the housing 24. Integrally formed in the top portion 36 is a projection member 42 which projects outwardly from the side wall 26 and provides a grasping surface that allows the user to easily insert and remove the refill insert 10.

The top of the housing 24 has formed therein an air ingress port 44 that is separated a distance from the ink egress port 34. Preferably, the ink egress port 34 and the air ingress port 44 are located on separate walls of the housing 24. However, in some embodiments, the ink egress port 34 and the air ingress port 44 may be located on a single wall of the housing 24 as will be later described and illustrated. The ink egress port 34 is in fluid communication with the printhead 22 of the ink jet printhead shell 12 (FIG. 1), to thereby provided a flow of ink from the housing 24 to the printhead 22 (FIG. 1).

Disposed substantially within the interior 30 of the housing 24 is a subhousing structure 46 that is configured to hold an ink entraining material (not shown). It is within the scope of the present invention that in some embodiments, a portion of the subhousing structure 46 could extend into the cap 14, however, in the preferred embodiment, the subhousing structure 46 is positioned entirely within the interior of the housing 24 as illustrated. Preferably, the subhousing structure 46 is generally triangular shaped and has an interior volume 48 formed by adjoining side and top walls 50,52 that are integrally formed with and project into the interior 30 of the housing 24. The subhousing structure 46 spans the distance between the ink egress port 34 and the air ingress port 44 with the interior volume 48 of the subhousing 26 encompassing the ink egress port 34. The subhousing structure preferably occupies less than ½, and more preferably less than ⅓ of the interior volume 48 of the housing to provide for a maximization of ink storage capacity that is greater than the prior art devices discussed above. For example, the embodiment of the present invention that is preferably applicable with the Hewlett-Packard 51633A Inkjet Cartridge can hold approximately 38 ml of ink, which is substantially greater than the ink capacities of the prior art devices discussed above. A portion of the side wall and a floor wall of the subhousing structure 46 are preferably common with the side wall 26 and the floor 28 of the housing 24. The various wall portions of the subhousing structure 46 join to form the interior volume 48 for containing an ink entraining material therein (not shown). The interior volume 48 of the subhousing structure 46 is in fluid communication with the interior 30 of the housing 24, preferably via an intermediate port 54 approximate the floor wall 28 of the housing 24 and is also in fluid communication with the ink egress port 34 and the air ingress port 44.

In a preferred embodiment, the intermediate port 54 comprises a gap formed between a portion of the side wall 50 of the subhousing structure 46 and the floor wall 28 of the housing 24. The intermediate port 54 allows for the ingress of air into the interior 30 of the housing 24 from the subhousing structure 46 and the egress of ink from the housing 24 into the interior volume 48 of the subhousing structure 46.

Located along an inner surface and formed in the side wall 50 of the subhousing structure 46 is an air channel 56 for allowing air to pass therethrough and between the ink entraining material (not shown) and the subhousing structure 46 to equalize the pressure of the housing 24 with an ambient atmospheric pressure external to the housing 24. Preferably, the air channel 56 is located on the hypotenuse portion of the side wall 50 proximate the intermediate port 54 and the floor wall 28 of the housing 24.

In those embodiments where the air ingress port 44 and the ink egress port 34 are not located on a single wall, the subhousing structure 46 may include a conduit 58. The conduit 58 is in fluid communication with the interior volume 48 of the subhousing structure 46 and the air ingress port 44 and extends from the subhousing structure 46 to the air ingress port 44, thereby placing the subhousing structure 46 and the air ingress port 44 in fluid communication with each other.

Figure 3:
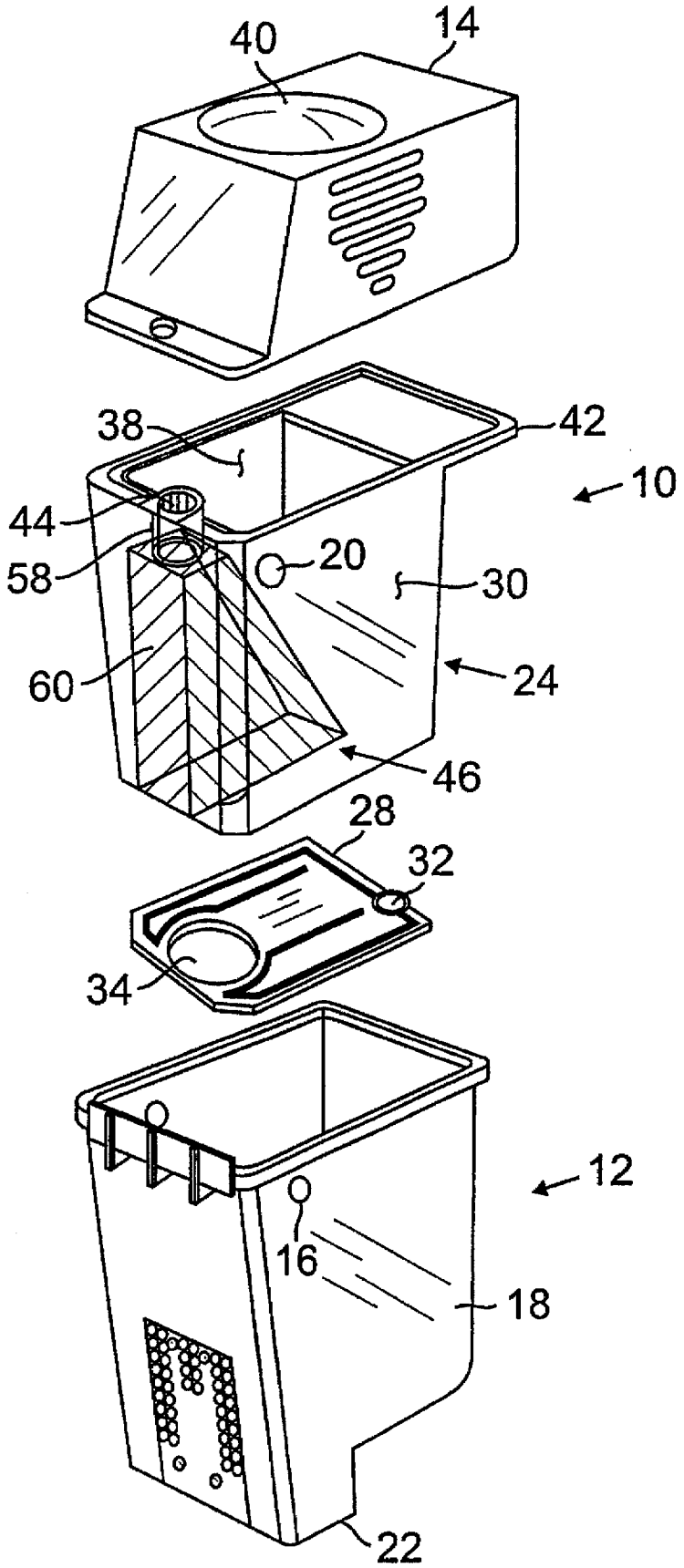
FIG. 3 illustrates an exploded view of the refill insert and the ink cartridge shell.
Figure 4:
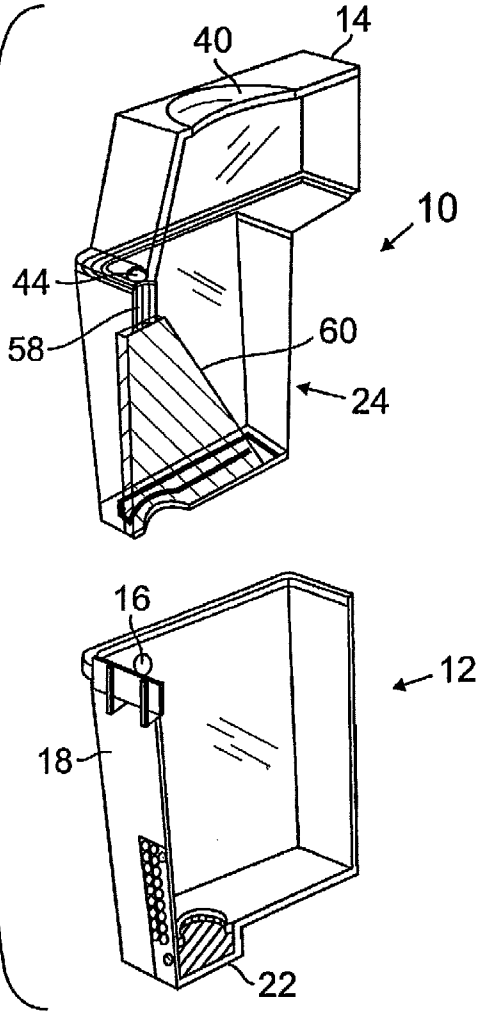
FIG. 4 illustrates a cross-section of the refill insert and the ink cartridge shell.

Turning now to FIGS. 3 and 4, there is illustrated an exploded view of the refill insert 10 and ink cartridge housing 24 previously discussed. Positioned within the subhousing structure 46 is an ink entraining material 60. Preferably, the ink entraining material 60 occupies the entire interior volume of the subhousing structure 46, however, in some embodiments the ink entraining material may occupy less than the entire interior volume of the subhousing structure 46. The ink entraining material 60 is preferably comprised of a sponge material that has good capillary and ink entraining properties. These properties allow for an efficient transfer of ink, via capillary action, from the interior of the housing 24 to the interior of the subhousing structure 46. Once the ink is absorbed into the ink entraining material 60, the ink is held therein until the ink is pulled from the ink entraining material 60 into the printhead 22 by a vacuum generated by the operation of the printhead 22.

Figure 5:
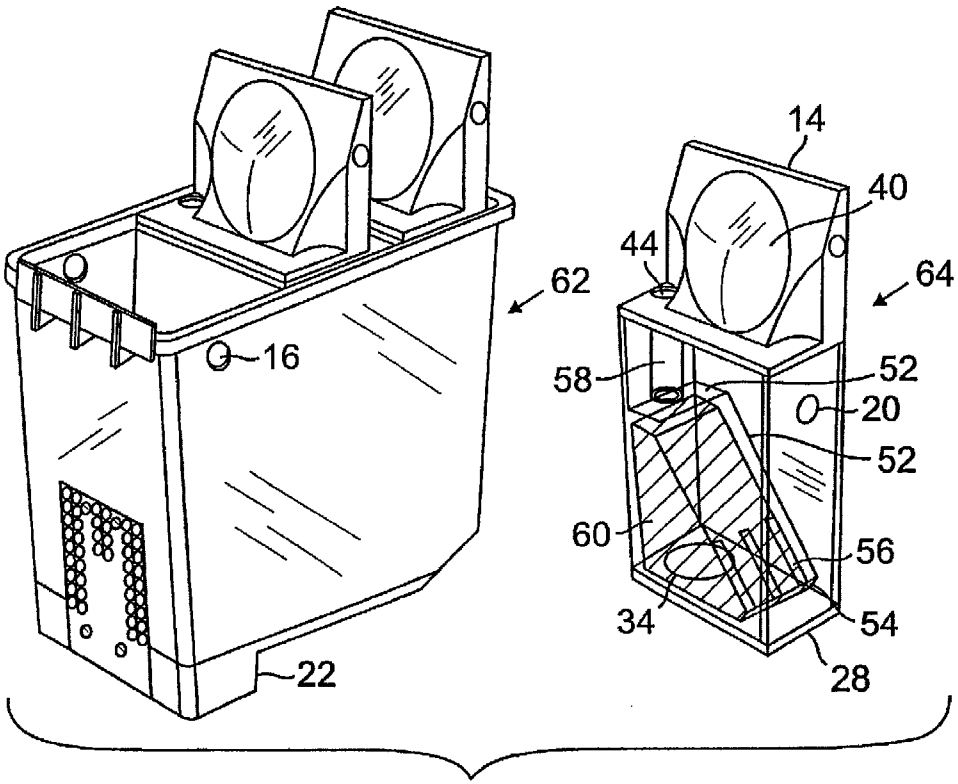
FIG. 5 illustrates an alternative embodiment of the system wherein a plurality of refill inserts cartridges are received within a multi-ink capacity housing with one of the plurality removed from the housing.

Turning now to FIG. 5, there is illustrated a conventional ink jet printhead shell 62 that is capable of dispensing multiple colors of ink and receiving a plurality of the refill inserts 64 therein. The refill inserts 64 that are applicable with the multi-colored ink jet printhead shell 62 have the same features as those previously described for the refill insert 10 that is applicable with the Hewlett-Packard 51633A Inkjet Cartridge. However, the refill inserts 64 are smaller, with the size depending on the size of the host ink jet printhead shell 62 and the number of colors required by the design of the host ink jet printhead shell 62. When used with the conventionally sized multi-colored ink jet printhead shell 62 illustrated in FIG. 5, each of the refill inserts 64 is capable of holding approximately 9 ml. of ink, which is substantially a greater ink capacity than similar devices of the prior art.

The other salient features of the refill insert 64 are designated identically to the refill insert 10 as illustrated in FIG. 2.

Figure 6:
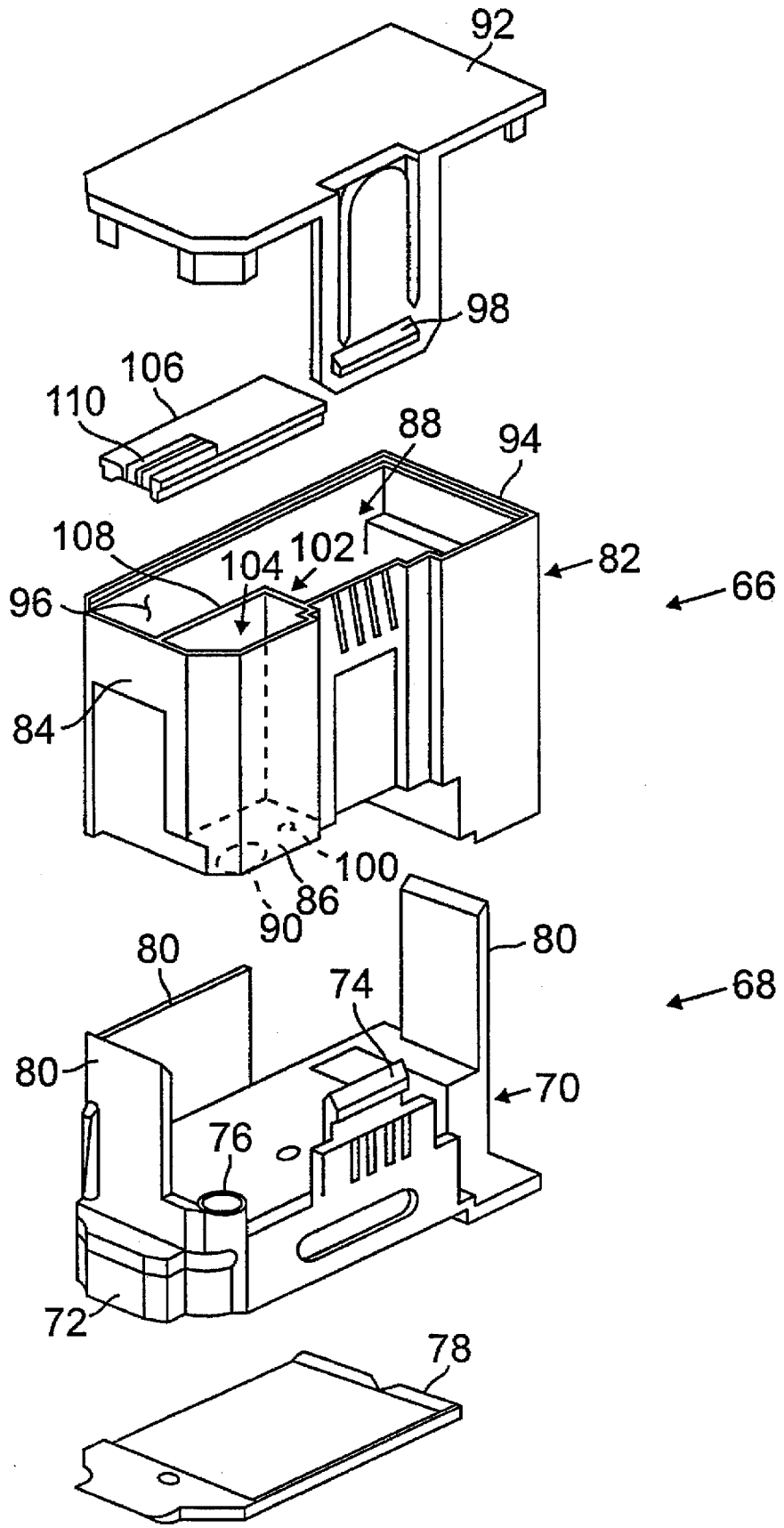
FIG. 6 illustrates an exploded view of an alternate embodiment the refill insert that is preferably applicable with the Canon BJ Cartridge BC-02.

Turning now to FIG. 6, there is illustrated an exploded view of an alternate embodiment of a refill insert 66 of the present invention. This particular embodiment is applicable to printheads similar to the Canon BJ Cartridge BC-02. The ink jet printhead structure 68 in this particular embodiment is comprised of printhead body structure 70 on which the printhead 72 and electrical interface (not shown) are positioned. The printhead body structure 70 includes a locking member 74 and is configured to receive the refill insert 66 therein. Projecting upwardly from the printhead body structure 70 is an ink conduit 76 that provides a passageway for the ink from the refill insert 66 to the printhead 72. A separate cover member 78 is optionally provided to protectively cover the electrical interface (not shown) which is positioned on the underside of the printhead body structure 70. Preferably, the printhead body structure 70 further includes partial side walls 80 that provide additional support for holding the refill insert 66.

The refill insert 66 comprises a generally rectangular housing 82 having a side wall 84 secured to a floor wall 86 that form an interior portion 88 of the housing 82. The floor wall 86 has an ink egress port 90 that receives the ink conduit 76 and allows a flow of ink from the housing 82 to the printhead 72. A cap 92 is secured by conventional means to the top portion 94 of the housing 82 and sealingly covers an opening 96 of the housing 82 to prevent the leakage of ink therefrom. Preferably, the cap 92 further includes a locking member 98 for lockingly interengaging the locking member 74 on the printhead body structure 70.

The housing 82 also includes an air ingress port 100 that is separated a distance from the ink egress port 90, which is formed in the floor wall 86. Preferably, the ink egress port 90 and the air ingress port 100 are located on the floor wall 86. However, in some embodiments, the ink egress port 90 and the air ingress port 100 may be located on separate walls of the housing 82. The ink egress port 90 is in fluid communication with the printhead 72, to thereby provide a flow of ink from the housing 82 to the printhead 72.

Disposed substantially within the interior portion 88 of the housing 82 is a subhousing structure 102 that is configured to hold an ink entraining material (not shown). Preferably, the subhousing structure 102 is positioned entirely within the interior portion 88 of the housing 82 as illustrated. The subhousing structure 102 preferably has a generally rectangular shape and an interior volume 104 formed by adjoining walls 86 and 106,108 that are integrally formed with and project into the interior portion 88 of the housing 82. The subhousing structure 102 spans the distance between the ink egress port 90 and the air ingress port 100 with the interior volume 104 of the subhousing structure 102 encompassing the ink egress port 90 and the air ingress port 100. The subhousing structure preferably occupies less than ½, and more preferably less than ⅓ of the interior volume 104 of the housing 82 to provide for a maximization of ink storage capacity that is greater than the prior art devices discussed above. For example, this particular embodiment is applicable preferably with the Canon Bubble Jet Cartridge BC-02 can hold approximately 35 ml of ink, which is significantly greater than the ink capacities of these sponge filled prior art devices.

Located along an inner surface and formed in the wall 106 of the subhousing structure 102 is an air channel 110 for allowing air to pass therethrough and between the ink entraining material (not shown) and the subhousing structure 102 to equalize the pressure of the housing 82 with an ambient atmospheric pressure external to the housing 82. Preferably, the air channel 110 is formed on the inner surface of the wall 106 and terminates near side wall 84 of the housing 82. Preferably, the wall 106 does not contact the side wall 84 and thereby forms an intermediate port (not shown) or gap between the side wall 84 of the housing 82 and the wall 106 in the same way as discussed for the embodiments illustrated in FIGS. 2–5. The intermediate port allows for the ingress of air into the interior portion 88 of the housing 82 from the subhousing structure 102 and the egress of ink from the interior portion 88 and into the interior volume 104 of the subhousing structure 102.

A portion of the side wall and floor wall of the subhousing structure 102 are preferably common with the side wall 84 and the floor wall 86 of the housing 82. The various wall portions of the subhousing structure 102 join to form the interior volume 104 for containing an ink entraining material (not shown) therein. The interior volume 104 of the subhousing structure 102 is in fluid communication with the interior portion 88 of the housing 82, preferably via the intermediate port (not shown) proximate the side wall 84 of the housing 82 and is also in fluid communication with the ink egress port 90 and the air ingress port 100.

In summation, the refill insert 66 illustrated in FIG. 6 incorporates the same unique aspects as previously discussed above for the embodiment illustrated in FIGS. 2–4.

With the preferred embodiments having been described in detail, the operation of the present invention will now be described. The housing structure of the refill insert 66, including the floor wall and the cap portions are manufactured and secured together by conventional means. The walls that comprise the subhousing are integrally formed in and with the housing structure. Prior to the time that the floor wall is secured to the housing, the ink entraining material is placed in the interior of the subhousing. Once the refill insert is assembled, it is filled with ink and inserted in the ink jet printhead and locked into place by engaging the corresponding locking members that are on the refill insert 66 and the ink jet printhead with each other. In those embodiments that include a primer structure, the primer structure is engaged, thereby priming the refill insert 66.

As the printhead is operated, a vacuum is generated by the expulsion of the ink that draws ink from the ink entraining material within the subhousing. As the ink saturation point of the ink entraining material is decreased, the capillary action of the material draws more ink from the interior housing through the intermediate port. When the ink is drawn from the housing, the internal pressure of the housing is equalized by air entering the housing through the air ingress port. The air passes through the air ingress port and along the air channels that are formed in an inner surface of the subhousing. The air channels terminate at and enters the housing through the intermediate port, thereby equalizing the pressure within the housing so as not to create a vacuum. From the foregoing, the present invention provides a refill insert 66 that is couplable to an ink jet printhead. The refill insert 66 comprises a housing that has an enclosed, defined volume therein for receiving a predetermined quantity of ink. Included substantially within the structure of the housing is a subhousing having an interior volume in fluid communication with the defined volume of the housing. The housing further includes an ink egress port and an air ingress port that is separated a distance from the ink egress port and are in fluid communication with the subhousing. The ink egress port, which is in fluid communication with the printhead, and the air ingress port may be located on a single wall of the subhousing or they may be located on separate walls of the subhousing. Additionally, the subhousing and the housing may share a common wall. The subhousing completely spans the distance separating the ink egress port and the air ingress port with the interior volume of the subhousing encompassing the ink egress port. An ink entraining material, which is preferably comprised of a sponge, is disposed in the subhousing and is adapted to allow the ink to flow from within the housing to the ink egress port. Air enters the subhousing via the air ingress port to equalize a pressure of the housing with an ambient atmospheric pressure external to the housing.

Although the present invention and its advantages have been described in detail, it should be understood that various changes, substitutions and alterations can be made herein without departing from the spirit and scope of the invention as defined by the appended claims.

What is claimed is:

1. A refill insert couplable to an ink jet printhead, said refill insert comprising:

a housing having a defined volume therein for receiving a predetermined quantity of ink and having an ink egress port and an air ingress port separated a distance from said ink egress port;

a subhousing located within said housing and spanning said distance and having an interior volume defined by at least two walls projecting into said defined volume of said housing, said interior volume encompassed by said defined volume of said housing about said at least two walls and in fluid communication with said defined volume of said housing and said air ingress port; and an ink entraining material disposed in said subhousing allowing said ink to flow from within said housing to said ink egress port, said ink entraining material having capillaries that retain and allow the flow of ink therethrough, air entering said subhousing by way of said air ingress port to thereby equalize a pressure of said housing with an ambient atmospheric pressure external to said housing.

2. The refill insert as recited in claim 1 wherein said ink entraining material comprises a sponge.

3. The refill insert as recited in claim 1 wherein said ink entraining material is disposed in an entirety of said interior volume of said subhousing.

4. The refill insert as recited in claim 1 wherein said subhousing includes a conduit extending from said interior volume to said air ingress port to allow fluid communication between said subhousing and said air ingress port.

5. The refill insert as recited in claim 1 wherein said subhousing shares a common wall with said housing, said subhousing further includes an air channel located along an inner surface on one of said at least two walls, said air channel allowing air to pass through said ink entraining material and from said subhousing to thereby equalize said pressure of said housing with said ambient atmospheric pressure.

6. The refill insert as recited in claim 1 wherein said ink egress port and said air ingress port are located on a same wall of said housing.

7. The refill insert as recited in claim 1 wherein said ink egress port and said air ingress port are located on separate walls of said housing.

8. The refill insert as recited in claim 1 wherein said ink egress port is in fluid communication with said printhead.

9. The refill insert as recited in claim 1 further comprising an intermediate port, proximate a floor of said housing, for communicating ink from within said housing to within said interior volume of said subhousing.

10. The refill insert as recited in claim 1 further comprising a primer for selectively increasing said pressure of said housing.

11. The refill insert as recited in claim 1 wherein a portion of said housing is received within an ink jet printhead cartridge shell, said shell having an open end and adapted to receive said refill in said shell.

12. The refill insert as recited in claim 1 wherein said insert includes means for attaching said insert to said ink jet printhead.

13. A refill insert for an ink cartridge, said ink cartridge including a shell having an open end and adapted to receive said refill insert in said shell, said refill insert comprising:

a housing having a defined volume therein for receiving a predetermined quantity of ink and having an ink egress port and an air ingress port separated a distance from said ink egress port;

a subhousing located within said housing and spanning said distance and having an interior volume defined by at least two walls projecting into said defined volume of said housing, said interior volume encompassed by said defined volume of said housing about said at least two walls and in fluid communication with said defined volume of said housing and said air ingress port; and an ink entraining material disposed in said subhousing allowing said ink to flow from within said housing to said ink egress port, said ink entraining material having capillaries that retain and allow the flow of ink therethrough, air entering said subhousing by way of said air ingress port to thereby equalize a pressure of said housing with an ambient atmospheric pressure external to said housing.

14. The refill insert as recited in claim 13 wherein said ink entraining material comprises a sponge.

15. The refill insert as recited in claim 13 wherein said ink entraining material is disposed in an entirety of said subhousing.

16. The refill insert as recited in claim 13 wherein said subhousing includes a conduit extending from said interior volume to said air ingress port to allow fluid communication between said subhousing and said air ingress port.

17. The refill insert as recited in claim 13 wherein said subhousing shares a common wall with said housing, said subhousing further includes an air channel located along an inner surface on one of said at least two walls, said air channel allowing air to pass through said ink entraining material and from said subhousing to thereby equalize said pressure of said housing with said ambient atmospheric pressure.

18. The refill insert as recited in claim 13 wherein said ink egress port and said air ingress port are located on a same wall of said housing.

19. The refill insert as recited in claim 13 wherein said ink egress port and air ingress port are located on separate walls of said housing. wall.

20. The refill insert as recited in claim 13 wherein said ink egress port is in fluid communication with a printhead that is coupled to said refill insert by way of said ink cartridge.

21. The refill insert as recited in claim 13 further comprising an intermediate port, proximate a floor of said housing, for communicating ink from within said housing to within said subhousing.

22. The refill insert as recited in claim 13 further comprising a primer for selectively increasing said pressure of said housing.

23. A method of providing a supply of ink to an ink jet printhead by way of a refill insert, said method comprising the steps of:

coupling said refill insert to said ink jet printhead:

by way of a housing having an enclosed, defined volume therein and having an ink egress port and an air ingress port separated a distance from said ink egress port, providing a subhousing within said housing for flowing a quantity of ink therefrom;

flowing a quantity of ink from said subhousing, said subhousing spanning said distance and having an interior volume defined by at least two walls projecting into said defined volume of said housing, said interior volume encompassed by said defined volume of said housing about said at least two walls and in fluid communication with said defined volume of said housing and said air ingress port, and flowing a quantity of ink from an ink entraining material, said ink entraining material disposed in said subhousing and allowing said ink to flow from within said housing to said ink egress port, said ink entraining material having capillaries that retains and allows said flowing of said quantity of ink therethrough, air entering said subhousing by way of said air ingress port to thereby equalize a pressure of said housing with an ambient atmospheric pressure external to said housing; and causing said ink to flow from within said housing to a printhead that is coupled to said housing by way of said ink egress port.

24. The method as recited in claim 23 wherein said ink entraining material is a sponge and wherein said step of causing comprises the step of entraining said ink in said sponge.

25. The method as recited in claim 23 further comprising the step of disposing said ink entraining material in an entirety of said subhousing.

26. The method as recited in claim 23 wherein said step of causing comprises the step of allowing fluid communication between said subhousing and said air ingress port by way of a conduit.

27. The method as recited in claim 23 further comprising the step of allowing air to pass through an air channel located along an inner surface of said subhousing to thereby equalize said pressure of said housing with said ambient atmospheric pressure.

28. The method as recited in claim 23 further comprising the step of locating said ink egress port and said air ingress port on a same wall of said housing.

29. The method as recited in claim 23 further comprising the step of locating said ink egress port and said air ingress port on separate walls of said housing.

30. The method as recited in claim 23 wherein said step of coupling comprises the step of inserting said refill insert such that said subhousing and said housing share a common wall.

31. The method as recited in claim 23 further comprising the step of communicating fluid between said ink egress port and said ink jet printhead.

32. The method as recited in claim 23 further comprising the step of communicating ink from within said housing to within said subhousing by way of an intermediate port proximate a floor of said housing.

33. The method as recited in claim 23 further comprising the step of selectively increasing said pressure of said housing with a priming structure.

34. The method as recited in claim 23 wherein said ink jet printhead is coupled to an ink jet printhead shell, said shell having a wall, said step of coupling comprises the step of engaging a locking member positioned on an exterior wall of said insert with a corresponding locking member positioned on said wall of said ink jet printhead shell.

35. A refill insert couplable to an ink jet printhead, wherein said ink jet printhead is coupled to an ink jet printhead shell, said shell having a wall, said refill insert comprising:

a housing having a defined volume therein for receiving a predetermined quantity of ink and having an ink egress port in fluid communication with said printhead and an air ingress port separated a distance from said ink egress port;

a subhousing located within said housing, sharing a common wall with said housing and spanning said distance and having an interior volume defined by at least two walls projecting into said defined volume of said housing, said interior volume encompassed by said defined volume of said housing about said at least two walls and in fluid communication with said defined volume of said housing by way of an intermediate port proximate a floor of said housing and said air ingress port, and said subhousing further having an air channel located along an inner surface thereof;

a sponge disposed in an entirety of said interior volume of said subhousing and having capillaries therein to retain said ink, air entering said subhousing through said air ingress port and passing between said housing and said subhousing by way of said air channel, to thereby equalize a pressure of said housing with an ambient atmospheric pressure external to said housing; and a fastener for attaching said insert to said ink jet printhead.

36. The refill insert as recited in claim 35 wherein said subhousing includes a conduit extending from said interior volume to said air ingress port to allow fluid communication between said subhousing and said air ingress port.

37. The refill insert as recited in claim 35 wherein said ink egress port and said air ingress port are located on a same wall of said housing.

38. The refill insert as recited in claim 35 wherein said ink egress port and said air ingress port are located on separate walls of said housing.

39. The refill insert as recited in claim 35 further comprising a primer for selectively increasing said pressure of said housing.

40. The refill insert as recited in claim 35 wherein a portion of said housing is received within an ink jet printhead cartridge shell, said shell having an open end and adapted to receive said refill insert in said shell.

41. The refill insert as recited in claim 35 wherein said fastener comprised a locking member formed on a wall of said insert that is interengagable with a corresponding locking member formed on said wall of said ink jet printhead shell.

* * * * *